US007780111B2

(12) United States Patent
Elbel

(10) Patent No.: US 7,780,111 B2
(45) Date of Patent: Aug. 24, 2010

(54) ROLL STORAGE MODULE AND METHOD FOR ITS OPERATION

(75) Inventor: Antoine Guillaume Elbel, Berne (CH)

(73) Assignee: Talaris Holdings Limited, London (GB)

( * ) Notice: Subject to any disclaimer, the term of this patent is extended or adjusted under 35 U.S.C. 154(b) by 92 days.

(21) Appl. No.: 12/084,781

(22) PCT Filed: Dec. 12, 2006

(86) PCT No.: PCT/GB2006/004640

§ 371 (c)(1),
(2), (4) Date: Jun. 27, 2008

(87) PCT Pub. No.: WO2007/068911

PCT Pub. Date: Jun. 21, 2007

(65) Prior Publication Data

US 2009/0134262 A1 May 28, 2009

(30) Foreign Application Priority Data

Dec. 16, 2005 (GB) ..... 0525676.3

(51) Int. Cl.
*B65H 39/14* (2006.01)

(52) U.S. Cl. ..... 242/528; 242/412.3; 242/420.2; 271/216

(58) Field of Classification Search ..... 242/528, 242/390.2, 412.1, 412.3, 413.1, 420, 420.1, 242/420.2; 271/3.01, 216
See application file for complete search history.

(56) References Cited

U.S. PATENT DOCUMENTS

| | | | | |
|---|---|---|---|---|
| 3,191,882 | A | 6/1965 | Reidel | |
| 4,126,817 | A * | 11/1978 | Luzio | 242/414.1 |
| 4,494,359 | A * | 1/1985 | Honegger | 53/430 |
| 4,496,142 | A | 1/1985 | Iwasaki | |
| 4,589,603 | A | 5/1986 | Muller | |
| 6,533,207 | B2 * | 3/2003 | Eugster et al. | 242/528 |
| 6,568,673 | B2 | 5/2003 | Mochizuki et al. | |
| 6,669,136 | B2 | 12/2003 | Niioka et al. | |
| 6,715,753 | B1 * | 4/2004 | Conca et al. | 271/216 |
| 2001/0045489 | A1 * | 11/2001 | Eugster et al. | 242/528 |
| 2002/0113160 | A1 | 8/2002 | Niioka et al. | |
| 2004/0173708 | A1 | 9/2004 | Neumann et al. | |
| 2005/0017428 | A1 | 1/2005 | Ichikawa et al. | |

FOREIGN PATENT DOCUMENTS

| | | |
|---|---|---|
| JP | A-09-151011 | 6/1997 |
| JP | A-10-181972 | 7/1998 |

* cited by examiner

*Primary Examiner*—William A Rivera
(74) *Attorney, Agent, or Firm*—Oliff & Berridge, PLC

(57) ABSTRACT

A roll storage module comprises a storage roll (4) and a band roll (1). A band (3) extends between the storage and band rolls, the rolls being rotatable so that the band can be rolled around and unrolled from each roll. A storage roll motor (5) applies a rotational torque directly to the storage roll (4), a band roll motor (2) applies a rotational torque directly to the band roll (1). A control system (6) controls the motors (2,5) so as to cause the band (3) to roll on and unroll from the storage and band rolls (1,4) respectively in a determined manner. The control system includes a processor (6) for monitoring rotation of the band roll (1), and for calculating one or more parameters relating to the band (3) based on the monitored band roll rotation thereby to control the band and storage roll motors to rotate their respective rolls in the determined manner.

17 Claims, 3 Drawing Sheets

ROLL STORAGE MODULE AND METHOD FOR ITS OPERATION

The invention relates to a roll storage module and a method for operating a roll storage module.

A typical roll storage module comprises a storage roll; a band roll; a band extending between the storage and band rolls, the rolls being rotatable so that the band can be rolled around and unrolled from each roll; a storage roll motor for applying a rotational torque to the storage roll; a band roll motor for applying a rotational torque to the band roll; and a control system for controlling the motors so as to cause the band to roll on and unroll from the storage and band rolls respectively in a determined manner.

Roll storage modules are used to store documents, particularly documents of value such as banknotes, vouchers and other tokens. They can be used in document storage devices, document dispensers and document recyclers. An example of a banknote dispenser is the TCR Twinsafe manufactured and sold by De La Rue International Limited. Other examples are described in U.S. Pat. Nos. 6,568,673, 4,496,142 and 3,191,882.

In a typical roll storage module system, it is necessary to monitor the position of the band as it is unrolled and rolled up so that the position of documents such as banknotes is known. This enables the identity of a banknote being dispensed at any particular time to be determined. It is also important to control the speed of the band between the two rolls and usually this should be maintained at a constant value. Finally, the tension on the band needs to be maintained at a predetermined target tension to ensure that documents are properly held in position and to centre the band so that it stays layered correctly.

Conventionally, parameters such as position of the band have been determined by causing the band to pass over an idler wheel located between the two rolls and a slotted wheel whose rotation is monitored using an opto-sensor. This provides direct monitoring of the speed of the band and also the position of the band. Band tension can be monitored if such an idler wheel is mounted on an arm which is spring biased against the band. The tension in the band is proportional to the relative position of the roller arm. A simple microswitch mounted at a set position is used to trigger the fact that the tension has reached a required value.

However, there is a risk that there will be relative slippage between the band and the idler while the volume taken up by the idler and opto-sensor together with their cost is undesirable.

An attempt to address this problem is described in U.S. Pat. No. 6,669,136. In this apparatus, rotation of both the storage roll and band roll is directly monitored and this enables parameters such as the diameters of the rolls to be calculated. Tension is maintained in the rolls by driving them at different angular speeds and using a torque limiter. This again suffers from problems of complexity and the need to monitor rotation of both rolls.

Further examples of roll storage modules in which both the storage and band rolls are separately driven by respective motors are described in US2002/0113160 and US2005/0017428. In both these cases a torque limiter is used as in U.S. Pat. No. 6,669,136. Operation of the systems is monitored by means of a pulse counter coupled with the storage roll drive motor. Not only do these systems suffer from the need to include a torque limiter but they need to apply complex algorithms to handle monitoring of the operation of the system because the relationship between rotation of the storage roll and positioning etc will vary in response to the number of documents stored on the storage roll, the document thicknesses and compressibility.

In accordance with a first aspect of the present invention, a roll storage module comprises a storage roll; a band roll; a band extending between the storage and band rolls, the rolls being rotatable so that the band can be rolled around and unrolled from each roll; a storage roll motor for applying a rotational torque directly to the storage roll; a band roll motor for applying a rotational torque directly to the band roll; and a control system for controlling the motors so as to cause the band to roll on and unroll from the storage and band rolls respectively in a determined manner characterized in that the control system includes a processor for monitoring rotation of the band roll, and for calculating one or more parameters relating to the band based on the monitored band roll rotation thereby to control the band and storage roll motors to rotate their respective rolls in the determined manner.

In accordance with a second aspect of the present invention, a method of operating a roll storage module comprising a storage roll; a band roll; a band extending between the storage and band rolls, the rolls being rotatable so that the band can be rolled around and unrolled from each roll; a band roll motor for applying a rotational torque directly to the band roll; and a storage roll motor for applying a rotational torque directly to the storage roll, the method comprising controlling the motors so as to cause the band to roll on and unroll from the storage and band rolls respectively in a determined manner, characterized by monitoring rotation of the band roll, calculating one or more parameters relating to the band based on the monitored band roll rotation and thereby controlling the band and storage roll motors to rotate their respective rolls in the determined manner.

With this invention, we are able to omit the idler and opto-sensor completely and thus reduce the cost of the roll storage module. Furthermore, with this invention it is only necessary to monitor rotation of the band roll and not both as in the case of U.S. Pat. No. 6,669,136. It is also not necessary to provide a torque limiter, the motors being connected directly to the respective rolls.

If the band roll motor is formed as a stepper motor then rotation of the roll can be linked directly to the number of steps by which the motor has rotated.

It is particularly advantageous to monitor the band roll rotation (as opposed to the storage roll) because the outer radius of the band roll does not vary in accordance with document thickness, the gap between documents and the like. In contrast, the radius of the storage roll will have this variation unless the document thickness and inter document spacings are very accurately controlled.

It should also be appreciated that the invention is applicable to both single band roll storage modules in which a single band extends between the two rolls and documents are stored between one turn of the band and the previous turn of the band; and dual band roll storage modules in which documents are stored between a pair of overlapping bands.

The parameters which are calculated typically comprise one or more of the position of the band as it is rolled and unrolled; the speed of the band; and the tension on the band. These comprise the most critical parameters when operating a roll storage module.

Preferably, the position (L) of the band relative to a band end position is computed by the processor in accordance with the formula:

$$L = 2\pi \times n\left(R_K + \frac{Th \times n}{2}\right)$$

where

Ln is the length of the band wound on the band roll as a function of n;

n is the number of revolutions made by the band roll since band end;

$R_k$ is the band roll radius; and,

Th is the band thickness.

It will be seen that the only variable in this calculation is "n" i.e. the number of revolutions made by the band roll since the position of the band roll when there were no turns of the band on the band roll (i.e. the band end). It would be possible to modify this formula by choosing a different "band end position" somewhere spaced from the true band end and in that case the value $R_k$ would be modified to equal the radius of the roll plus the thickness of turns of the band existing at that stage on the band roll.

Preferably, the control system is adapted to control the speed of the band by monitoring the angular speed of the band roll and controlling the torque applied by the storage roll motor to the storage roll so as to reduce the difference between the monitored angular speed of the band roll and a target angular speed.

This can be done directly by determining the target angular speed of the band roll and comparing it with the angular speed as monitored by the control system processor. Alternatively, the linear speed of the band between the rolls could be calculated from the angular speed of the band roll and compared with a target linear speed.

Typically, the target angular speed of the band roll is dependent upon the length of the band wound on the band roll and in the preferred arrangement, the control system is adapted to calculate the target angular speed of the band roll ($\omega_T$) in accordance with the formula:

$$\omega_T = v_B/(R_K + nTh)$$

where $v_B$ is the target linear velocity of the band;

$R_K$ is the band roll radius;

n is the number of revolutions made by the band roll since the band end; and,

Th is the band thickness.

Preferably, the control system is adapted to control band tension by monitoring a drive signal applied to the band roll motor, and adjusting the signal to a desired target signal dependent on the length of band wound onto the band roll.

The drive signal is typically a drive current but could be a drive voltage or a digital control signal.

Where the drive signal is a drive current, the target current ($i_{target}$) is preferably calculated in accordance with the formula:

$$i_{target} = ((R_k + n \cdot Th) \cdot T_{target})/K_m$$

where $T_{target}$ is a desired band tension;

$K_m$ is a predetermined constant (N·m/A);

$R_K$ is the band roll radius;

n is the number of revolutions made by the band roll since the band end; and,

Th is the band thickness.

The motors are preferably stepper motors since the number of steps through which the motors rotate can be easily converted to roll rotations. However, other types of motor could be used as will be recognised by a person of ordinary skill in the art.

An example of a roll storage module and method according to the present invention will now be described with reference to the accompanying drawings, in which:—

Figure 1:
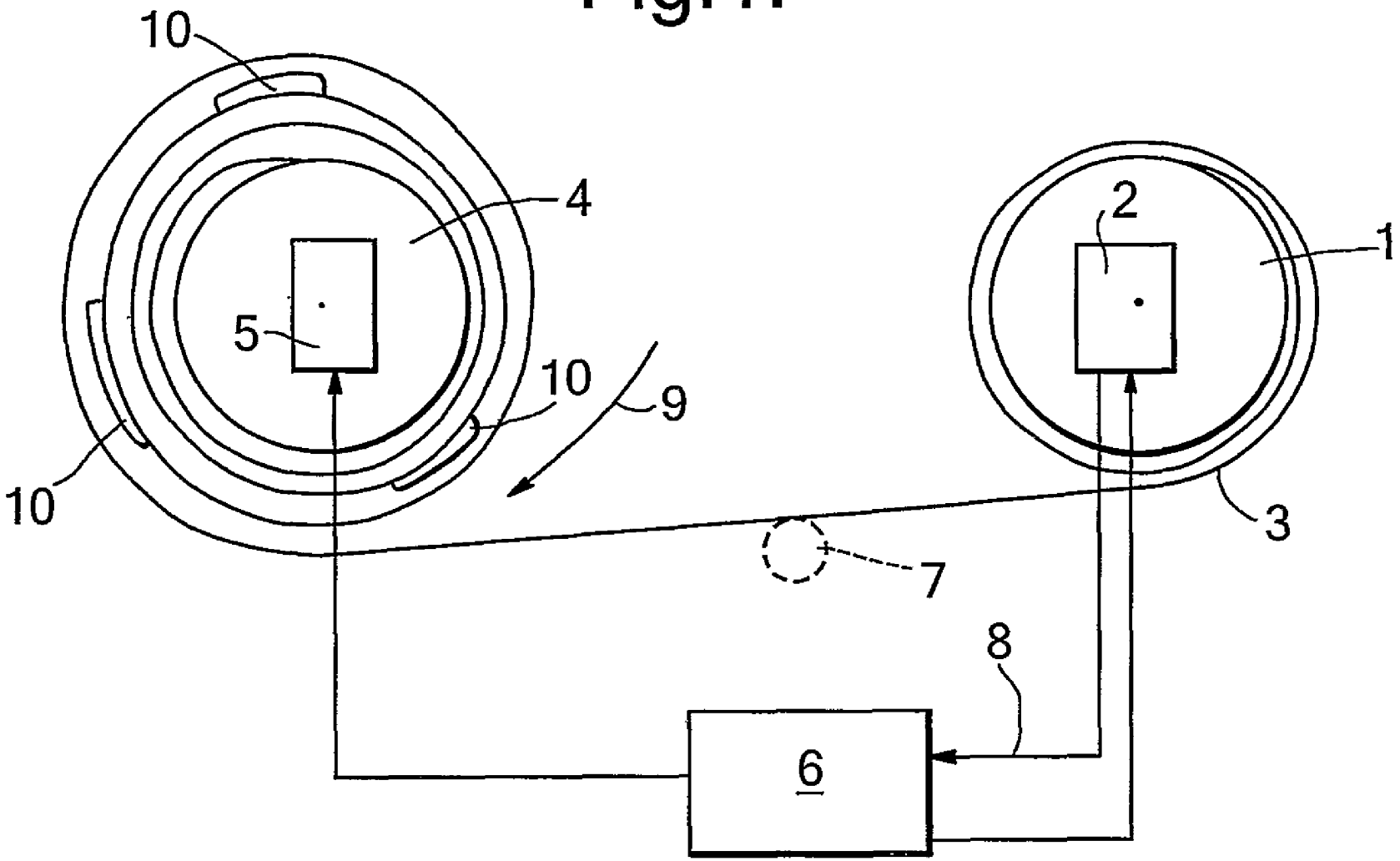
FIG. 1 is a schematic diagram of a roll storage module.

FIG. 1 illustrates very schematically a roll storage module comprising a band roll 1 coupled for rotation to a band roll stepper motor 2. A band 3 is partially wound around the band roll 1 and extends to, and is partially wound around, a storage roll 4. The storage roll 4 is driven by a stepper motor 5. Each stepper motor 2,5 is driven by a control system processor 6. Other conventional components of the roll storage module, such as a scraper, have been omitted for clarity.

In some conventional roll storage modules, an idler 7, shown in dashed lines, engages the band 3 between the rolls 1,4 and rotates in response to movement of the band. This rotation is then monitored using an opto-sensor.

In other cases, a torque limiter is connected between one of the motors 2,5 and the corresponding roll 1,4. In the present invention, the idler 7 and torque limiter are dispensed with and instead the stepper motor 2 outputs signals corresponding to each step through which the motor 2 is rotated, these signals being fed along a line 8 to the processor 6. A suitable stepper motor driver which issues such signals is manufactured by Microbeam and described for example in U.S. Pat. No. 6,326,760. Rotation of the motor 5 is not monitored.

In use, when a banknote is to be stored on the storage roll 4, the banknote is fed by a transport system (not shown) in the direction of an arrow 9 into the space between the portion of the band extending between the rolls and the previous turn of the band on the storage roll 4. The storage roll 4 and the band roll 5 are each driven by their respective stepper motors 5,2 in a clockwise direction so that the incoming banknote is drawn onto the storage roll 4 and secured between successive turns of the band. FIG. 1 illustrates three banknotes 10 located on the storage roll 4.

It is important to maintain the tension of the band at a predetermined level ($T_{target}$), to maintain the velocity of the band at a predetermined velocity $v_B$, to monitor the position of the band in order to be able to maintain a record of the location of each banknote 10, and to avoid note jams.

In the present invention, only signals from the stepper motor 2 are used as will be explained below.

Monitoring Band Position

The position of the band is monitored by reference to the length of the band (L) wound onto the band roll 1. This is achieved by utilizing the formula set out below derived by determined the cross-sectional area of the band on the band roll 1 and dividing this by the thickness of the band. The derivation is as follows:

$$L = (\Pi r^2 - \Pi R_k^2)/T_h$$

Where r is the current radius of the band roll 1, and $r_k$ is the band roll radius.

Though r is not a constant and not measured, r can be expressed in terms of available constants and measured values, using the formula:

$$r = (n \times T_h) + R_k$$

Substituting this formula for r in equation 1 gives us:

$$L=[\Pi\{(n\times T_h)+R_k\}^2-\Pi R_k^2]/T_h$$

Which simplifies by taking the Π outside the brackets:

$$L=\Pi[\{(n\times T_h)+R_k\}^2-R_k^2]/T_h$$

Then expanding the squared term in the curly brackets gives:

$$L=\Pi[\{(n\times T_h)^2+R_k^2+2(n\times T_h)R_k\}-R_k^2]/T_h$$

The curly brackets can be removed and the plus and minus $R_k^2$ terms cancel each other out.

$$L=\Pi[(n\times T_h)^2+2(n\times T_h)R_k]/T_h$$

Which simplifies by taking the n outside the brackets:

$$L=\Pi n[n\times T_h^2+2(T_h)R_k]/T_h$$

Which simplifies by cancelling the multiplier and denominator $T_h$:

$$L=\Pi n(n\times T_h+2R_k)$$

Which can also be written as:

$$L=2\Pi n[R_k+\{(n\times T_h)/2\}]$$

The value of L can then be equated with each banknote at it is stored on the storage roll 4 so that when banknotes are retrieved from the storage roll, they can be identified with reference to the value L.

Control of Band Speed

Band speed is controlled in the following way. In a first step 20 (FIG. 2), the number of steps undergone by the band motor is determined and from this (step 22) the number of band roll revolutions (n) is calculated. In this example, it is assumed that there is a simple relationship between the number of steps undergone by the band motor and the number of band roll revolutions but this will vary depending upon the gear ratios between the motor and the band roll.

In a step 24, a target angular speed of the band roll ($\omega_T$) is calculated in accordance with the formula:

$$\omega_T=v_B/(R_K+nTh)$$

where $v_B$ is the target velocity of the band;

$R_K$ is the band roll radius;

n is the number of revolutions made by the band roll since the band end; and,

Th is the band thickness.

It will be appreciated that the target angular speed of the band roll will vary in accordance with the number of turns of the band on the band roll if the band velocity $v_B$ is to remain constant.

The actual angular speed of the band roll ($\omega_{actual}$) is then determined by the processor 6 by reference to the number of steps undergone by the band motor per second (step 26).

Finally, the angular speed at which the storage roll 4 is rotated by the motor 5 is adjusted to reduce any difference between $\omega_T$ and $\omega_{actual}$. In this way, the band speed is brought to the desired constant value $v_B$ (step 28).

Figure 2:
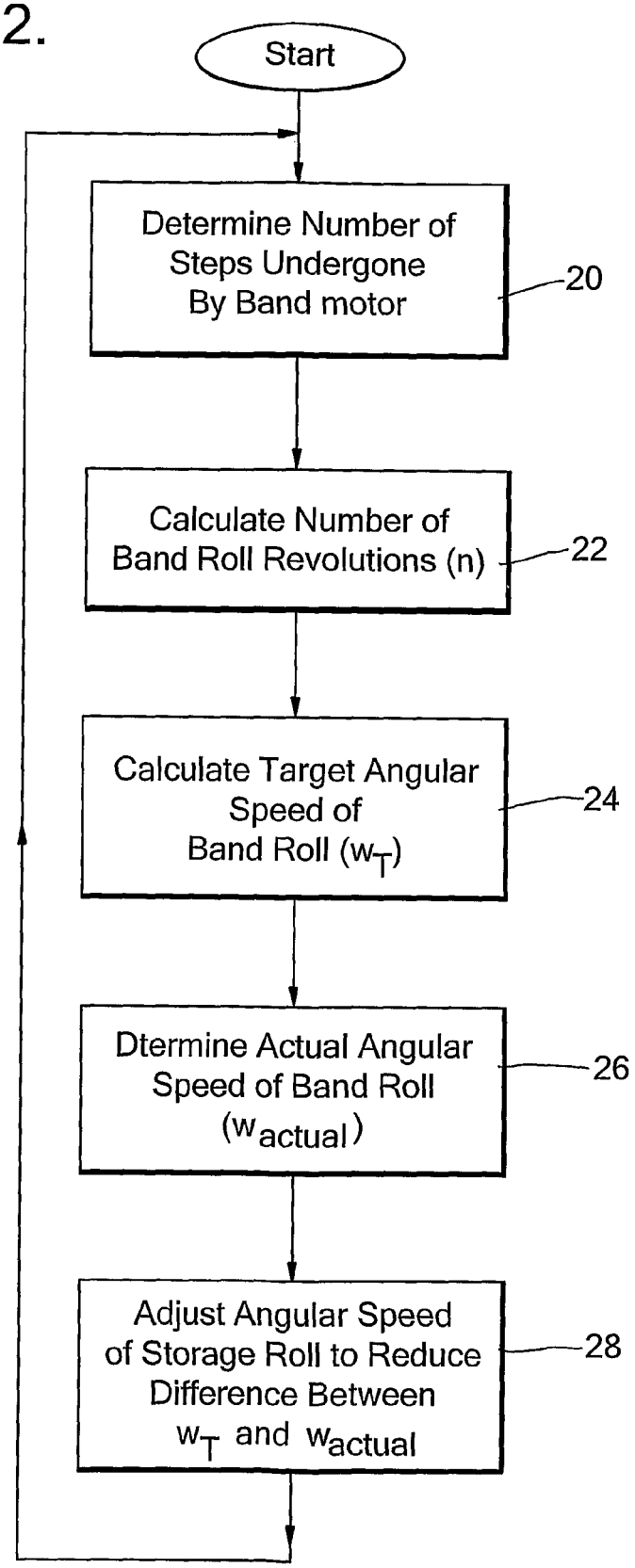
FIG. 2 is a flow diagram illustrating a method for controlling the speed of the band; and, FIG. 3 is a flow diagram illustrating a method for controlling the band tension.

The process then repeats as shown in FIG. 2.

Control of Band Tension

Figure 3:
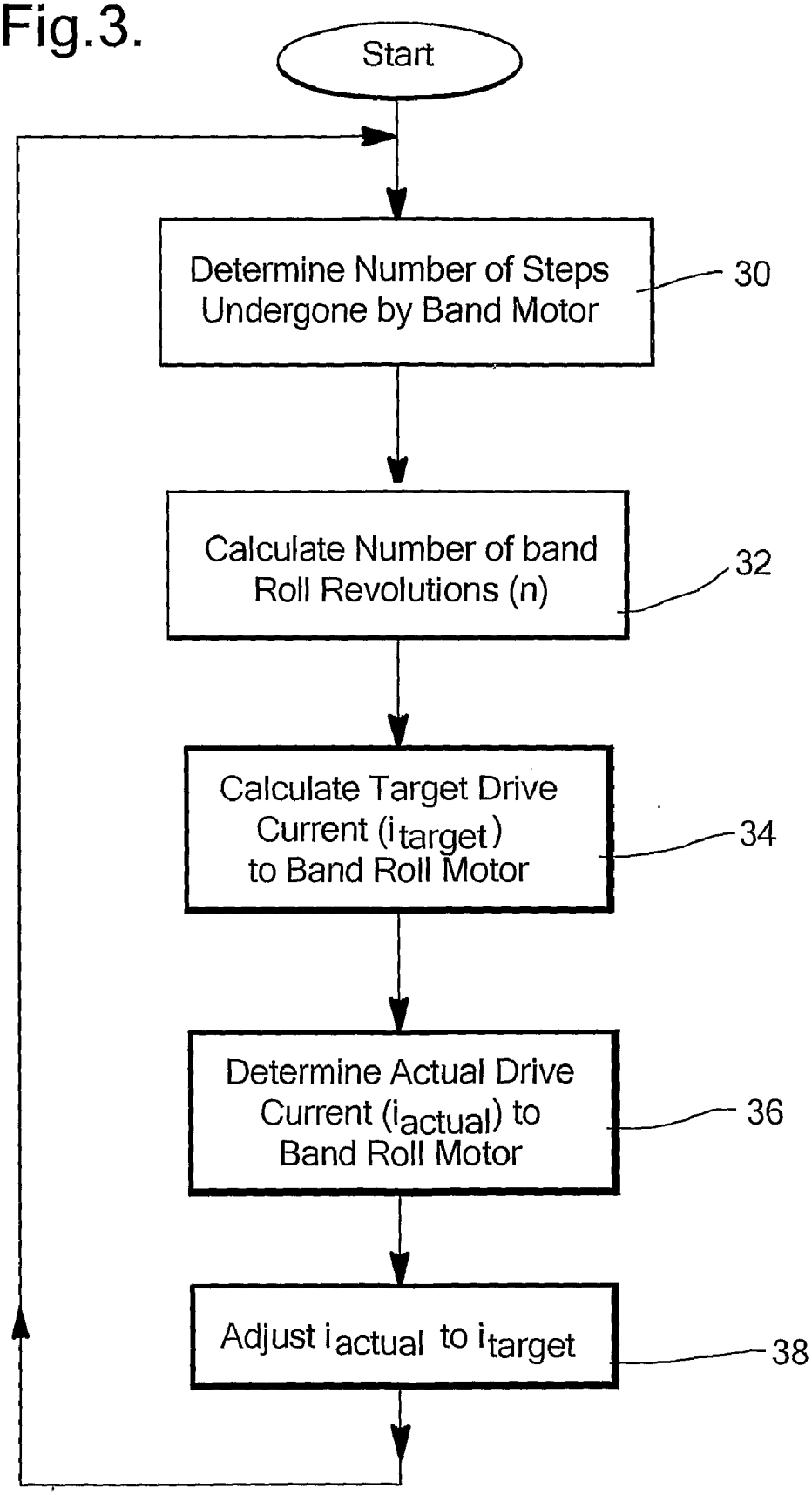

The method by which band tension is controlled is illustrated by the flow diagram of FIG. 3.

Initially, in a step 30, the number of steps undergone by the band motor is determined and then the number of band roll revolutions (n) is calculated through knowledge of the number of steps corresponding to a single band roll revolution (in a similar way to the process described above) (step 32).

In this example, the stepper motor 2 is driven with a drive current whose magnitude is varied by the control processor 6 in a conventional manner. To achieve a target tension $T_{target}$, the target current ($i_{target}$) is calculated (step 34) in accordance with the formula:

$$i_{target}=((R_k+n\cdot Th)\cdot T_{target})/K_m$$

Based on $M_b=r\cdot T_{target}$

Where $M_b$ is the band motor torque r the radius of the band drum $T_{target}$ the target band tension $$r=R_k+n\cdot Th$$

Where $R_k$ is the radius of the plastic drum and n·Th the radius of the band windings $$M_b=K_m\cdot I_{target}$$

Where $K_m$ is the torque constant (a motor characteristics) in N·m/A and $I_{target}$ is the current in the motor windings.

n is the number of revolutions made by the band roll since the band end; and, Th is the band thickness.

In a step 36, the processor 6 determines the actual drive current ($i_{actual}$) being applied to the band roll motor 2 and then in a step 38 adjusts this actual current to be the same as the target current.

Each of the three processes described above could be carried out in parallel by the processor 6 or at spaced time intervals.

The invention claimed is:

1. A roll storage module comprising:

a storage roll;

a band roll;

a band extending between the storage roll and the band roll, the storage roll and the band roll being rotatable so that the band can be rolled around and unrolled from each roll;

a storage roll motor for applying a rotational torque directly to the storage roll;

a band roll motor for applying a rotational torque directly to the band roll;

and a control system for controlling the motors so as to cause the band to roll on and unroll from the storage roll and the band roll respectively in a predetermined manner wherein the control system includes a processor for monitoring rotation of the band roll, and for calculating one or more parameters relating to the band based on the monitored band roll rotation thereby to control the band and storage roll motors to rotate their respective rolls in the predetermined manner, the parameters being selected from (1) the position of the band as it is rolled and unrolled, (2) the speed of the band, and (3) the tension on the band, wherein the position Ln of the band is computed by the processor in accordance with the formula:

$$Ln = 2\pi\times n\left(R_K+\frac{Th\times n}{2}\right)$$

where

Ln is the length of the band wound on the band roll as a function of n;

n is the number of revolutions made by the band roll since band end;

RK is the band roll radius; and,

Th is the band thickness.

2. A module according to claim 1, wherein the control system is adapted to control the speed of the band by monitoring the angular speed of the band roll and controlling the torque applied by the storage roll motor to the storage roll so as to reduce the difference between the monitored angular speed of the band roll and a target angular speed of the band roll ωT.

3. A module according to claim 2, wherein the target angular speed of the band roll is dependent upon the length of the band wound on the band roll.

4. A module according to claim 3, wherein the control system is adapted to calculate the target angular speed of the band roll ωT in accordance with the formula:

$$\omega_T = V_B/(R_K + nTh)$$

where vB is the target linear velocity of the band;

RK is the band roll radius;

n is the number of revolutions made by the band roll since the band end; and, Th is the band thickness.

5. A module according to claim 1, wherein the control system is adapted to control band tension by monitoring a drive signal applied to the band roll motor, and adjusting the signal to a desired target signal dependent on the length of band wound on the band roll.

6. A module according to claim 5, wherein the drive signal is a drive current, and wherein the target current itarget is calculated in accordance with the formula:

$$i_{target} = ((R_K + n.Th).T_{target})/K_m$$

where

Ttarget is a desired band tension;

Km is a predetermined constant (N.m/A);

RK is the band roll radius;

n is the number of revolutions made by the band roll since the band end; and,

Th is the band thickness.

7. A module according to claim 1, wherein each motor is a stepper motor.

8. A module according to claim 1, wherein each motor is operated to apply torque to the storage roll and the band roll, respectively, to cause the storage roll and the band roll to rotate in the same sense relative to the band.

9. A document storing apparatus comprising a roll storage module according to claim 1; and a transport system for conveying documents from an inlet to the roll storage module.

10. A method of operating a roll storage module comprising:

a storage roll;

a band roll;

a band extending between the storage roll and the band roll, the storage roll and the band roll being rotatable so that the band can be rolled around and unrolled from each roll;

a band roll motor for applying a rotational torque directly to the band roll; and a storage roll motor for applying a rotational torque directly to the storage roll, the method comprising:

controlling the motors so as to cause the band to roll on and unroll from the storage roll and band roll, respectively, in a predetermined manner;

monitoring rotation of the band roll; and calculating one or more parameters relating to the band based on the monitored band roll rotation and thereby controlling the band and storage roll motors to rotate their respective rolls in the predetermined manner, the parameters being selected from (1) the position of the band as it is rolled and unrolled, (2) the speed of the band, and (3) the tension on the band, wherein the position Ln of the band relative to a band end position is computed by the processor in accordance with the formula:

$$Ln = 2\pi \times n\left(R_K + \frac{Th \times n}{2}\right)$$

where

Ln is the length of the band wound on the band roll as a function of n;

n is the number of revolutions made by the band roll since band end;

Rk is the band roll radius; and,

Th is the band thickness.

11. A method according to claim 10, comprising controlling the speed of the band by monitoring the angular speed of the band roll and controlling the torque applied by the storage roll motor to the storage roll so as to reduce the difference between the monitored angular speed of the band roll and a target angular speed.

12. A method according to claim 11, wherein the target angular speed of the band roll is dependent upon the length of the band wound on the band roll.

13. A method according to claim 12, comprising calculating the target angular speed of the band roll ωT in accordance with the formula:

$$\omega_T = V_B/(R_K + nTh)$$

where vB is the target velocity of the band;

RK is the band roll radius;

n is the number of revolutions made by the band roll since the band end; and,

Th is the band thickness.

14. A method according to claim 10, comprising controlling band tension by monitoring a drive signal applied to the band roll motor, and adjusting the signal to a desired target signal dependent on the length of band wound on the band roll.

15. A method according to claim 14, wherein the drive signal is a drive current, and wherein the target current itarget is calculated in accordance with the formula:

$$i_{target} = ((R_K + n.Th).T_{target})/K_m$$

where

Ttarget is a desired band tension;

Km is a predetermined constant (N·m/A);

RK is the band roll radius;

n is the number of revolutions made by the band roll since the band end; and, Th is the band thickness.

16. A method according to claim 10, wherein each motor is a stepper motor.

17. A method according to claim 10, wherein each motor is operated to apply torque to the storage roll and the band roll, respectively, to cause the storage roll and the band roll to rotate in the same sense relative to the band.

* * * * *